US008528480B2

(12) United States Patent
Seidel et al.

(10) Patent No.: US 8,528,480 B2
(45) Date of Patent: Sep. 10, 2013

(54) WARHEAD

(75) Inventors: Wolfgang Seidel, Lehre (DE); Michael Schwenzer, Hermannsburg (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 184 days.

(21) Appl. No.: 12/602,460

(22) PCT Filed: May 15, 2008

(86) PCT No.: PCT/EP2008/003881

§ 371 (c)(1),
(2), (4) Date: Nov. 30, 2009

(87) PCT Pub. No.: WO2008/145259

PCT Pub. Date: Dec. 4, 2008

(65) Prior Publication Data

US 2010/0192797 A1 Aug. 5, 2010

(30) Foreign Application Priority Data

May 30, 2007 (DE) ..... 10 2007 025 258

(51) Int. Cl.
*F42B 12/22* (2006.01)

(52) U.S. Cl.
USPC ..... 102/492

(58) Field of Classification Search
USPC ..... 102/493, 489, 492, 494, 495–497, 102/478, 476, 475, 213, 389, 214, 211, 212, 102/473
See application file for complete search history.

(56) References Cited

U.S. PATENT DOCUMENTS 3,768,414 A * 10/1973 Polcha ..... 219/121.17
3,818,833 A * 6/1974 Throner, Jr. ..... 102/389
4,175,491 A 11/1979 Thomanek
4,480,552 A * 11/1984 Eckel et al. ..... 102/393
4,494,459 A * 1/1985 Ziemba ..... 102/235
4,538,519 A * 9/1985 Witt et al. ..... 102/387

(Continued)

FOREIGN PATENT DOCUMENTS

DE 3721619 A1 1/1989
DE 3739370 A1 6/1989

(Continued)

OTHER PUBLICATIONS

International Search Report, issued in corresponding application PCT/EP2008/003881, completed Sep. 19, 2008, mailed Sep. 29, 2008.

(Continued)

*Primary Examiner* — Michael Carone
*Assistant Examiner* — Reginald Tillman, Jr.
(74) *Attorney, Agent, or Firm* — Griffin & Szipl, P.C.

(57) ABSTRACT

The invention relates to a warhead (10) for attacking particularly half-hard and/or soft targets, wherein the warhead comprises a splinter-forming casing (1) and an explosive material positioned in the casing (1). The warhead (10) further has a front plate (2) having a splinter formation, into which a distance sensor (3) is integrated. An igniter (5) for the explosive material and a stabilizing strap for adjusting perpendicular flight characteristics on the way to the target are located in the rear part of the warhead (10), wherein the initiation of the igniter (5) is determined by a property of the target to be attacked, namely, the parameter of a defined height from the target.

23 Claims, 4 Drawing Sheets

(56) References Cited

U.S. PATENT DOCUMENTS

| | | | | | |
|---|---|---|---|---|---|
| 4,612,859 | A | * | 9/1986 | Furch et al. | 102/476 |
| 4,658,727 | A | * | 4/1987 | Wilhelm et al. | 102/494 |
| 4,773,328 | A | * | 9/1988 | Germershausen et al. | 102/214 |
| 4,858,532 | A | * | 8/1989 | Persson et al. | 102/387 |
| 4,974,515 | A | | 12/1990 | Busch et al. | |
| 5,003,882 | A | * | 4/1991 | Frehaut et al. | 102/387 |
| 5,160,805 | A | | 11/1992 | Winter | |
| 5,229,542 | A | * | 7/1993 | Bryan et al. | 102/491 |
| 5,339,742 | A | * | 8/1994 | Hulderman et al. | 102/387 |
| 5,341,743 | A | * | 8/1994 | Redaud | 102/384 |
| 5,549,047 | A | | 8/1996 | Borgni | |
| 5,668,346 | A | * | 9/1997 | Kunz et al. | 102/387 |
| 6,874,425 | B1 | * | 4/2005 | Doughty | 102/489 |
| 7,004,075 | B2 | * | 2/2006 | Ronn et al. | 102/473 |
| 7,451,704 | B1 | * | 11/2008 | Gold et al. | 102/495 |
| 8,033,223 | B2 | * | 10/2011 | Sheridan et al. | 102/473 |
| 2002/0014177 | A1 | | 2/2002 | Renaud-Bezot et al. | |
| 2002/0020322 | A1 | | 2/2002 | Weber | |
| 2009/0078146 | A1 | * | 3/2009 | Tepera et al. | 102/473 |

FOREIGN PATENT DOCUMENTS

| | | | |
|---|---|---|---|
| DE | 3913543 | C1 | 10/1990 |
| DE | 90 15 932 | U1 | 2/1991 |
| DE | 29507361 | U1 | 9/1996 |
| DE | 29519568 | U1 | 4/1997 |
| DE | 19749168 | A1 | 5/1999 |
| DE | 10040800 | A1 | 3/2002 |
| DE | 19626660 | C2 | 6/2002 |
| DE | 60108817 | T2 | 1/2006 |
| DE | 202004019504 | U1 | 4/2006 |
| DE | 602 02419 | T2 | 5/2006 |
| EP | 0 350 821 | A | 1/1990 |
| EP | 1302741 | A1 | 4/2003 |
| EP | 1 452 825 | A1 | 9/2004 |
| EP | 1582837 | A1 | 10/2005 |

OTHER PUBLICATIONS

The article, Zukunftsvision—Das Heckler & Koch Oicw, Soldat Und Technik, German magazine, The future vision, Heckler & Koch Oicw, Soldier and Technology, Nov. 2001, pp. 34-39.

Internet website, www.rheinmetall-detec.de/product.php?fid = 1069& lang=2.

The definition of band clamp, downloaded Dec. 30, 2011, http://www.answers.com/topic/band-clamp.

The definition of casing, downloaded Dec. 30, 2011, http://www.answers.com/topic/casing.

Large Caliber Ammunition—Types of Warhead, globalsecurity.org, http://www.globalsecurity.org/military/systems/munitions/bullets2-warheads.htm (downloaded Sep. 17, 2012, 4:10 PM).

* cited by examiner

WARHEAD

This is a National Phase Application in the United States of International Patent Application No. PCT/EP2008/003881 filed May 15, 2008, which claims priority on German Patent Application No. 10 2007 025 258.9, filed May 30, 2007. The entire disclosures of the above patent applications are hereby incorporated by reference.

FIELD OF THE INVENTION

An explosive munition is used to attack widely different types of targets. In addition to the bombardment of buildings (infrastructure), in the case of artillery and mortar ammunition, these are so-called semi-hard targets (armored guns, etc.) as well as soft targets (lightly armored or unarmored vehicles, etc.). These projectiles are detonated on impact or above the target. Detonation above the target is achieved by means of a time fuze or a proximity fuze.

BACKGROUND OF THE INVENTION

EP 1 452 825 A 1 discloses a method for programming the breakup of projectiles. The detonation takes place while maintaining the optimum height with respect to the target, and at the breakup location.

The article "Zukunftsvision—Das Heckler & Koch OICW", Soldat and Technik ["The future vision—The Heckler & Koch OICW", German magazine Soldier and Technology], November 2001, pages 34-39 states that, in the "Burst Mode", the target is first of all assessed for direct flying, and the aiming device is corrected such that, when the soldier is aiming at the target, the shell has its flight path one meter above the target. The shell is then caused to detonate precisely at this point, by programming the shell with the range.

Known explosive projectiles normally have forged projectile casings which break up into a large number of small and less large fragments on detonation. The fragment distribution can be influenced by the treatment of the steel and by so-called break points, within certain limits. Depending on the fragment mass and the fragment speed, targets of different strength are penetrated. Increasing the proportion of large fragments leads to a reduction in the number of fragments, and this in turn leads to a low fragment density. The fragment energy and fragment density must therefore be matched to the attack. When one whishes to attack semi-hard targets, the fragments must be of a certain size and must have a certain energy. If the fragment density is not sufficient, more ammunition is required to carry out the mission. Furthermore, only a certain proportion of the fragments are effective, because of the ballistic flight path of the projectiles, with inclined approach angle to the surface of the Earth. The effect against different targets necessitates different projectile descent angles.

Explosive projectiles are known, inter alia, from DE 602 02 419 T2, DE 601 08 817 T2, DE 20 2004 019 504 U1, DE 295 19 568 U1, DE 39 13 543 C1 and DE 196 26 660 C2.

The explosive projectile from DE 602 02 419 T2 has an explosive charge which is arranged in a casing. The casing has at least two sectors, with the first sector having means which ensure fragment formation. However, the second sector has no such means.

The explosive projectile according to DE 20 2004 019 504 U1 has an insensitive explosive charge within a projectile casing, and a concrete-breaking penetration head with an insensitive fuze.

Bomblets that are fired admittedly fall virtually vertically and are effective against semi-hard targets because they have a shaped charge on the end face, but the effectiveness of the side casing fragments is quite restrictive (DE 295 07 361U1). A large number of bomblets are therefore required for a high hit and attack probability (PS-DE 37 39 370). In practice bomblets therefore often have a low-cost fuze, which themselves have the disadvantage that they do not always detonate, thus resulting in unexploded munitions.

U.S. Pat. No. 5,549,047 A discloses a fuze of complex design which is armed by the unfolded stabilization bands rotating a piercing unit from a safe position, thus releasing a firing capsule. During the process, a further safety pin is released, as a result of which the piercing unit is now pressed by a spring unit against the firing capsule, which has been moved under the piercing unit. This is assisted by balls which engage under a projection in the fuze housing. In the event of soft ground preventing the firing capsule from initiating, provision is made for a self-destruction mechanism to come into play, independently of the fall time and without delay after a defect of the primary initiation system. DE 100 40 800 A1 also deals with a bomblet fuze which has a safe setting, as a result of which no dangerous unexploded munitions occur.

DE 197 49 168 A1 describes a warhead for a rocket, with the object of requiring only a small number of munitions types to attack a relatively wide range of targets. The warhead proposed here is intended for attacking soft and semi-hard ground targets. As the payload the individual submunitions are in the form of disks and are provided on their end face with a fragment plate composed of preshaped fragments. After sufficient braking of the warhead, which is deployed to the target with the aid of a rocket, a warhead casing is then removed from the payload. In this case, the payload is still suspended on the braking parachute. On reaching a preselected height above the surface of the Earth a spin motor is initiated which accelerates the payload assembly to a specific rotation speed about the vertical longitudinal axis of the payload. The preselected height can be fixed in the design or can be selected as a function of the respective terrain. On reaching a second preselected height, a blocking mechanism is unlocked, as a result of which the submunitions leave the payload carrier at their respectively instantaneous tangential velocity.

Against this background, the invention is based on the object of providing a warhead, the number and effectiveness of which can be optimized for attacking different target types.

SUMMARY OF THE INVENTION

The object is achieved by the features of a first embodiment of the invention, namely, a warhead (10) for attacking, in particular, semi-hard and/or soft targets, wherein the warhead has a casing (1) which forms fragments, as well as explosive material which is located in the casing (1), having a front plate (2) with fragment formation, a proximity sensor (3), a fuze (5) for the explosive material and a stabilization band for setting a vertical flight path to the target, wherein initiation of the fuze (5) by the characteristic of the target to be attacked is governed by presetting a defined height with respect to the target. Advantageous refinements of the invention are specified as follows.

In accordance with a second embodiment of the invention, the first embodiment of the invention is modified so that the casing (1), which forms fragments, is a fragmentation jacket. In accordance with a third embodiment of the invention, the first embodiment is modified so that the casing (1), which forms fragments, is a casing with preformed fragments. In accordance with a fourth embodiment of the invention, the first embodiment, the second embodiment and the third embodiment are further modified so that preformed fragments are incorporated in the front plate (2). In accordance with a fifth embodiment of the invention, the first embodiment, the second embodiment, the third embodiment and the fourth embodiment are further modified so that the casing (1) has break points.

In accordance with a sixth embodiment of the invention, an artillery warhead (11) is provided that has a projectile casing (12), an ejection charger (13) and warheads (10), which are surrounded by the projectile casing (12), wherein the warheads (10) are warheads in accordance with the first embodiment, the second embodiment, the third embodiment, the fourth embodiment or the fifth embodiment of the invention. In accordance with a seventh embodiment of the invention, a mortar projectile is provided that has warheads (10) in accordance with the first embodiment, the second embodiment, the third embodiment, the fourth embodiment or the fifth embodiment of the invention. In accordance with an eighth embodiment of the invention, a rocket warhead is provided that has a projectile casing (12), an ejection charge (13) and warheads (10), which are surrounded by the projectile casing (12), wherein the warheads (10) are warheads in accordance with the first embodiment, the second embodiment, the third embodiment, the fourth embodiment or the fifth embodiment of the invention. In accordance with a ninth embodiment of the invention, a dispenser having warheads (10) is provided, wherein the warheads (10) are warheads in accordance with the first embodiment, the second embodiment, the third embodiment, the fourth embodiment or the fifth embodiment of the invention.

The invention is based on the idea of exactly matching the warhead to the attack shortly before the mission, for example, by programming. This is achieved in that the warhead is effective against semi-hard or soft targets by specific deployment of side and front fragments, depending on the detonation height. The detonation height or initiation height is signaled to the projectile, depending on the mission, for example by means of programming, and a proximity sensor in the projectile can also initiate detonation.

One warhead can therefore be used for semi-hard and soft targets, and the effectiveness at the target is governed solely by the detonation height, that is to say the detonation height for the warhead is preset on the basis of the target to be attacked.

The warhead preferably comprises a metallic casing which surrounds an explosive charge. The geometry may have different cross sections and lengths and is designed in an appropriate line for attacking the defined targets. The casing preferably comprises a cylindrical steel tube which breaks up into fragments in a known manner when the explosive charge is detonated.

Alternatively, it is likewise possible to use casings with "preformed fragments". For this purpose, the casing is, for example, composed of individual rings, each of which is prefragmented on the inside by a large number of grooves. On the side facing the target, the casing has a prefragmented steel plate, or the like. The steel plate and the side casing may be fragmented differently, in such a way that, for example, the front fragments can be used to attack semi-hard targets, and the side fragments to attack soft targets.

In order to allow the warhead to attack an optimum target area, the invention provides for the warhead to be equipped on the rear face with a stabilization system, for example, an unfolding mechanism, bands and/or a parachute etc., thus resulting in a defined descent angle to the Earth.

The warhead can be fired into the target area in many different ways. Depending on the way in which it is fired, a plurality of warheads can be stacked in one munition, such as artillery projectiles, mortar projectiles, rockets, dispensers etc.

By way of example, the novel warhead can be integrated in the conventionally known manner in a rocket warhead with the same dimensions and ballistic characteristics. The warhead then contains a plurality of warhead units in its payload area, the number, size and effect of which are designed for the attack scenarios. They are ejected from the warhead casing at a predetermined height above the target area and then fall with a specific spatial distribution into a defined area which is predetermined by the ejection charge and the ejection height. This area is preselected on the basis of the target type in such a way that the effectiveness radii of the individual submuntions attach, and possibly also overlap.

In order to initiate the detonation of the explosive charge, each warhead and each warhead unit is equipped with an electronic fuze, which is in turn initiated by a proximity sensor at a height above the target, which can be programmed before firing or, in an alternative mode, has a fixed setting.

The advantage is that the mission can be carried out with a small number of warheads matched to their effectiveness for the attack. Reducing the number of warheads to carry out a mission now makes it possible to also use reliable fuzes, thus avoiding unexploded munitions.

A warhead is therefore proposed for attacking, in particular, semi-hard and/or soft targets, having a casing which forms fragments as well as an explosive material which is located in the casing. Furthermore, the warhead has a front plate which forms fragments, in which a proximity sensor is integrated. The rear part of the warhead contains a fuze for the firing material or explosive material, as well as a stabilization band for selecting a vertical flight path to the target, wherein the initiation of the fuze by the characteristic of the target to be attacked is governed by presetting a defined height with respect to the target.

BRIEF DESCRIPTION OF THE DRAWINGS

The invention will be explained in more detail using one exemplary embodiment and with reference to the drawing, in which.

DETAILED DESCRIPTION OF THE INVENTION

Figure 1:
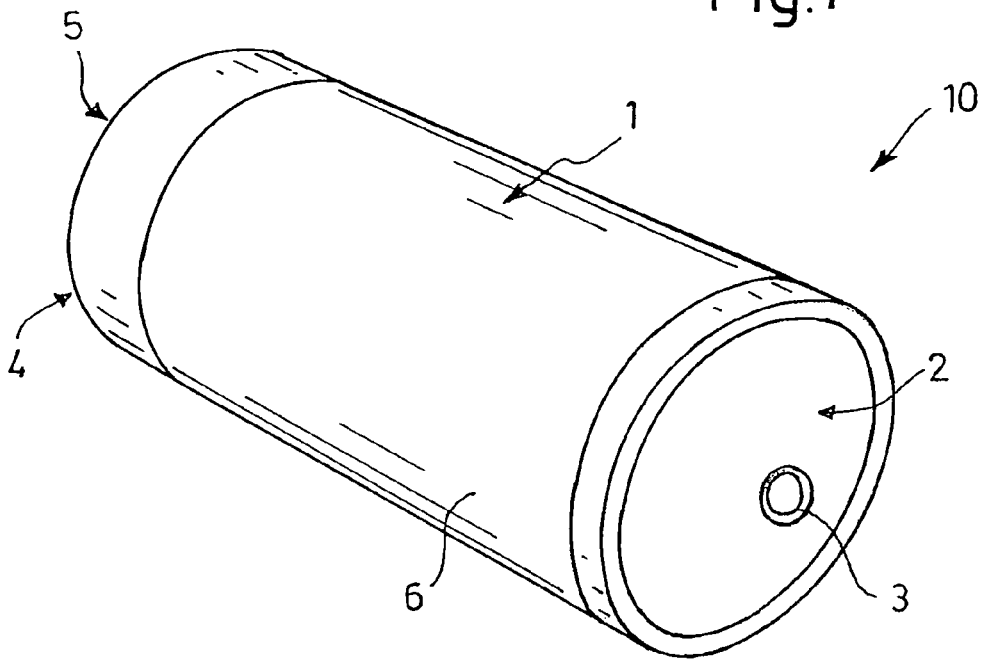
FIG. 1 shows a warhead.

FIG. 1 shows a warhead 10 with a fragment jacket 1 (casing which forms fragments), as well as a front plate 2 with preformed fragments. A proximity sensor is annoted as 3. Character reference 4 denotes a physical space for a fuze 5, which is not illustrated in any more detail, as well as a stowage space for a known stabilization system 15. The warhead 10 also has an explosive material 6, which is located under the fragment jacket 1 and is functionally and operatively connected in the conventional manner to the fuze 5.

Once the ballistically fired warhead 10 has established a predetermined flight path to the target area, it is separated from the ballistic missile, which is not illustrated in any more detail, in such a way that its stabilization system 16 can unfold. The warhead 10 can now descend into the target area, virtually vertically with respect to the target area. On reaching a predetermined height above the target area as confirmed by the proximity sensor 3, the fuze 5 is fired, and the fragment jacket 1 therefore breaks up. The fragment formation can be defined corresponding to the predetermined break points 17 in the fragment jacket 1. The front plate 3 is also likewise destroyed, and its fragment formation is enhanced by the preformed fragments that are incorporated. Side fragments and front fragments therefore act in the target area.

Figure 2:
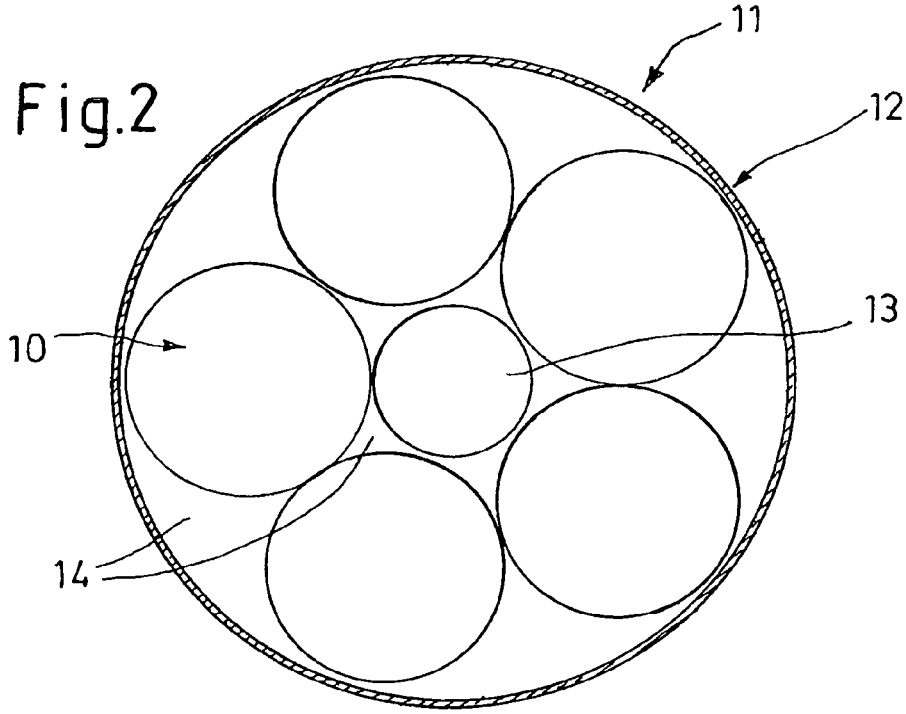
FIG. 2 shows a cross section through a rocket artillery warhead, with warheads as shown in FIG. 1.

FIG. 2 shows an artillery warhead 11 with a warhead casing 12 and the warheads 10, an ejection charge 13 as well as moldings 14 for support.

The warhead casing 12 is destroyed by the warhead units 10, which are themselves forced through the casing 12 by the ejection charge 13. Particularly, in the case of an artillery projectile or mortar projectile, the warhead units 10 are ejected to the rear. The operation of the individual units 10 is then the same as that described in FIG. 1.

Figure 3A:
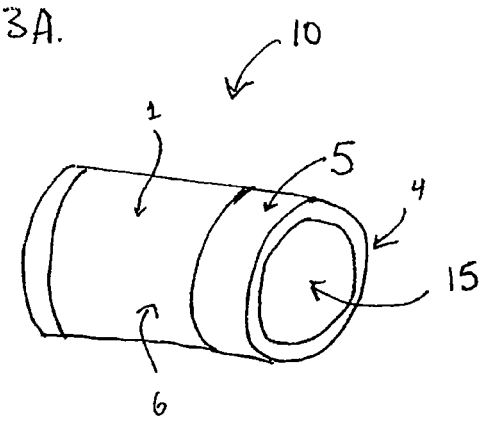
FIG. 3 illustrates the stowage space for a stabilization system and one possible embodiment of the stabilization system.
Figure 3B:
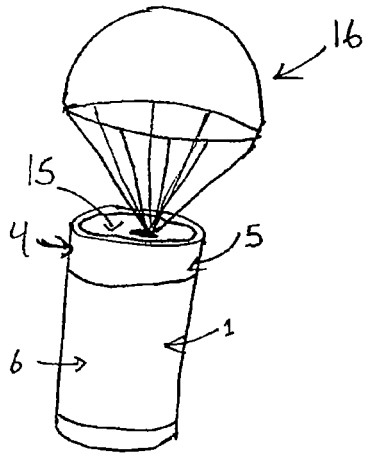

FIGS. 3 A and B show the stowage space for the stabilization system 15, and one embodiment of the stabilization system 16.

Figure 4:
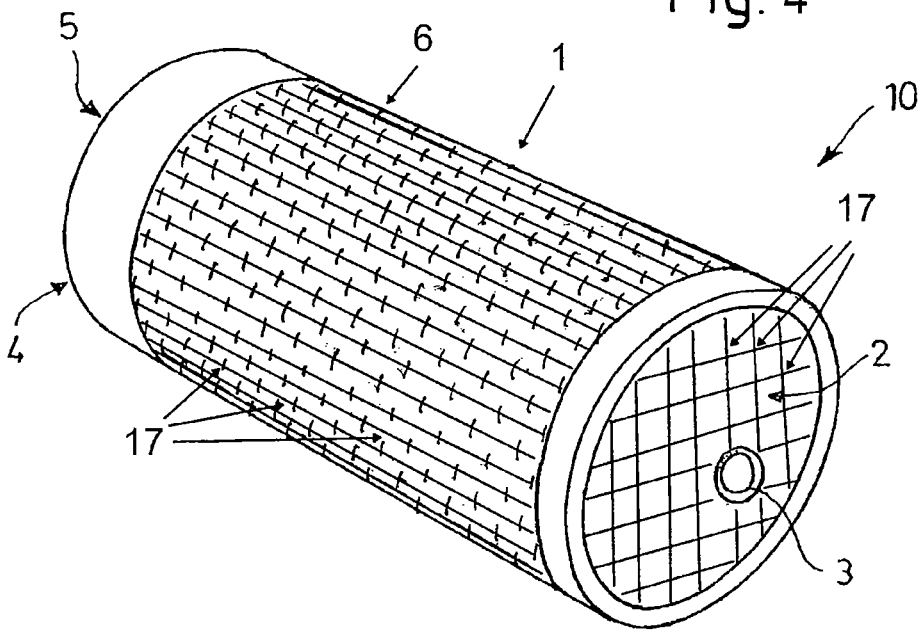
FIG. 4 illustrates the break points in the fragment jacket and front plate.

FIG. 4 shows the predetermined break points 17 in the fragment jacket 1 and the front plate 3.

Figure 5:
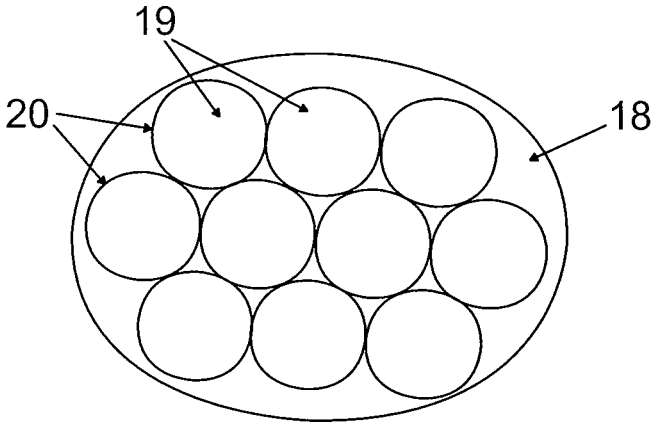
FIG. 5 illustrates the spatial distribution of the impact radii of the submunitions of the warhead.

FIG. 5 shows the spatial distribution 18 of the impact radii 19 of the submunitions of the warhead. The outer circumference 20 of the impact radii 19 touch.

Figure 6:
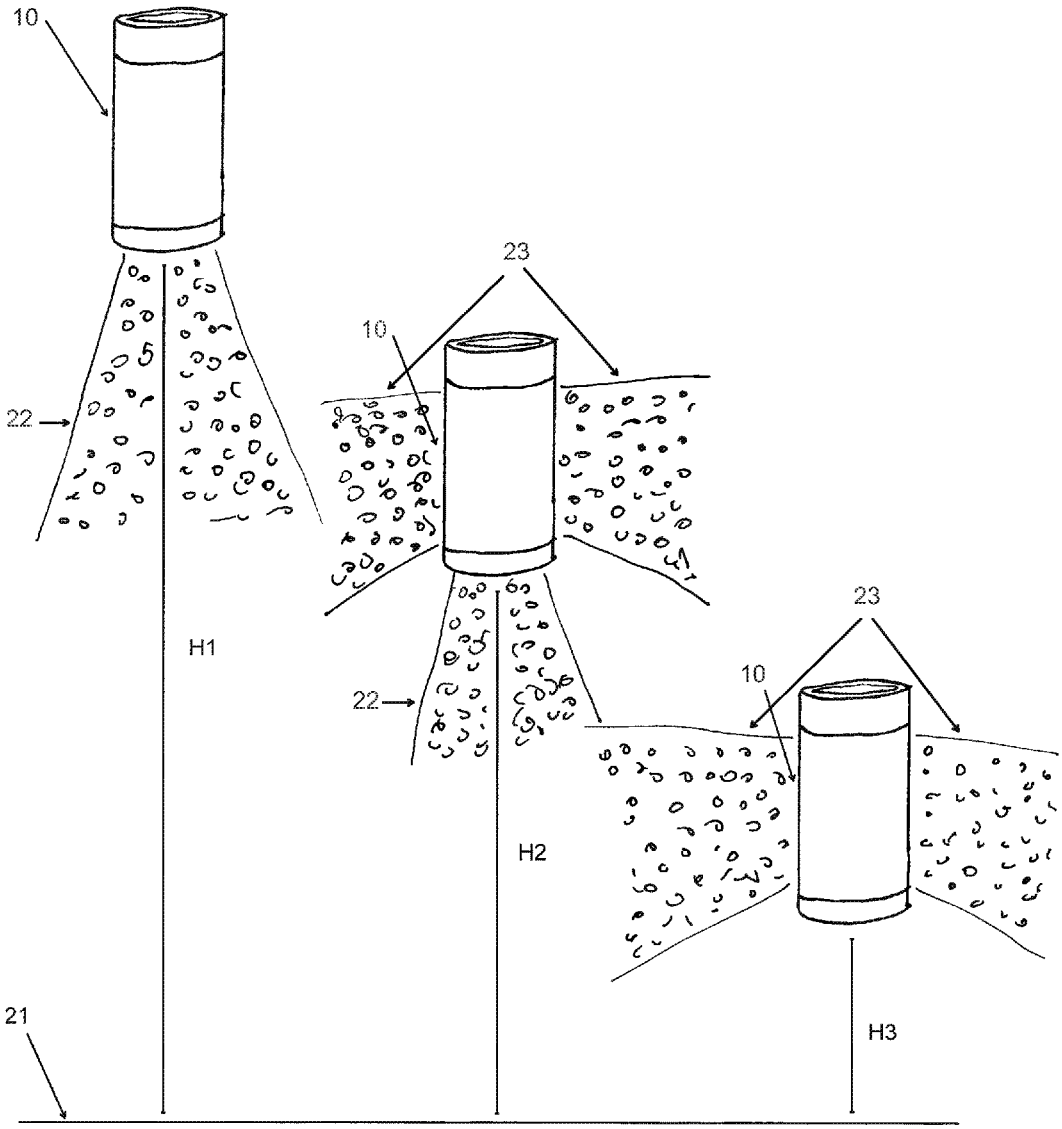
FIG. 6 illustrates the specific deployment of the fragments in a lateral direction of the warhead, or the front direction of the warhead, or the lateral and the front direction of the warhead depending on the preset detonation height.

FIG. 6 shows the specific deployment of the fragments in the front direction 22 of the warhead 10 at a preset detonation height H1 above the ground 21, the specific deployment of the fragments in the front direction 22 and the lateral direction 23 of the warhead 10 at a preset detonation height H2 above the ground 21, and the specific deployment of the fragments in the lateral direction 23 of the warhead 10 at a preset detonation height H3 above the ground 21. H1, H2 and H3 are not drawn to scale.

The invention claimed is:

1. A warhead for attacking semi-hard or soft or semi-hard and soft targets, the warhead comprising:

(a) a metallic side casing that forms fragments that are deployed in a lateral direction of the warhead;

(b) explosive material that is located in the casing;

(c) a front plate capable of forming fragments that are deployed in a front direction of the warhead, wherein the front plate is attached to the casing;

(d) a proximity sensor;

(e) a fuze connected to the explosive material; and (f) a stabilization system for setting a vertical flight path to a target, wherein initiation of the fuze is governed by presetting a defined height with respect to the type of target to be attacked, wherein the proximity sensor operates to confirm when the warhead is at the defined height, and wherein the specific deployment of the fragments in the lateral direction of the warhead, or the front direction of the warhead, or the lateral direction of the warhead and the front direction of the warhead, depends on the preset detonation height.

2. The warhead as claimed in claim 1, wherein the casing is a fragmentation jacket that forms fragments.

3. The warhead as claimed in claim 1, wherein the casing comprises preformed fragments such as a plurality of individual rings that are prefragmented on the inside by a plurality of grooves.

4. The warhead as claimed in claim 1, wherein the front plate comprises preformed fragments such as a plurality of individual rings that are prefragmented on the inside by a plurality of grooves.

5. The warhead as claimed in claim 1, wherein the casing has break points.

6. An artillery warhead comprising:

(A) a projectile casing;

(B) an ejection charger; and (C) warheads that are surrounded by the projectile casing, wherein each warhead is a warhead according to claim 1.

7. A mortar projectile comprising warheads, wherein each warhead is a warhead according to claim 1.

8. A rocket warhead comprising:

(A) a projectile casing;

(B) an ejection charge; and (C) warheads that are surrounded by the projectile casing, wherein each warhead is a warhead according to claim 1.

9. A dispenser comprising warheads, wherein each warhead is a warhead according to claim 1.

10. The warhead as claimed in claim 2, wherein preformed fragments are incorporated in the front plate.

11. The warhead as claimed in claim 3, wherein preformed fragments are incorporated in the front plate.

12. The warhead as claimed in claim 2, wherein the casing has break points.

13. The warhead as claimed in claim 3, wherein the casing has break points.

14. The warhead as claimed in claim 4, wherein the casing has break points.

15. The warhead as claimed in claim 10, wherein the casing has break points.

16. The warhead as claimed in claim 11, wherein the casing has break points.

17. The warhead as claimed in claim 1, wherein the stabilization system is selected from the group consisting of an unfolding mechanism, at least one stabilization band, and a parachute.

18. The warhead as claimed in claim 1, wherein the fuze is deposed at a rear end of the warhead.

19. The warhead as claimed in claim 1, wherein the proximity sensor is integrated with the front plate.

20. The warhead according to claim 1, wherein the side casing and the front plate are differently fragmented so that the properties of the side casing fragments are selected for attacking soft targets and the properties of the front plate fragments are selected for attacking semi-hard targets.

21. A warhead for attacking, in particular, semi-hard or soft or semi-hard and soft targets, the warhead comprising:

(a) a plurality of warhead units, each warhead unit including (i) a submunition;

(ii) a fuze connected to the explosive material, wherein initiation of the fuze is governed by presetting a defined height with respect to the type of target to be attacked;

(iii) a proximity sensor, wherein the proximity sensor operates to confirm when the warhead is at the defined detonation height;

(iv) a metallic side casing that forms fragments that are deployed in a lateral direction of the warhead;

(v) explosive material that is located in the casing;

(vi) a front plate capable of forming fragments that are deployed in a front direction of the warhead, wherein the front plate is attached to the casing;

(vii) a stabilization system for setting a vertical flight path to a target, (b) a main casing, wherein the warhead units are disposed inside the main casing;

(c) an expulsion charge; and (d) a main proximity sensor, wherein the main proximity sensor operates to confirm when the warhead is at the defined expulsion height, and wherein the specific deployment of the fragments in the lateral direction of the warhead units, or the front direction of the warhead units, or the lateral direction of the warhead units and the front direction of the warhead units, depends on the preset detonation height.

22. The warhead according to claim 21, wherein the plurality of warhead units are expelled from the warhead with a spatial distribution defined by the expulsion charge and the expulsion height, wherein each submunition has an impact radii and each impact radii has an outer circumference, and wherein the spatial distribution is specified so that the outer circumferences of the impact radii of the submunitions touch each other.

23. The warhead according to claim 22, wherein the outer circumferences of the impact radii of the submunitions overlap each other.

* * * * *